United States Patent [19]

Collins et al.

[11] 4,050,249

[45] Sept. 27, 1977

[54] CONTROL UNIT

[75] Inventors: George R. Collins, Rochester; William R. Large, Detroit, both of Mich.

[73] Assignee: General Motors Corporation, Detroit, Mich.

[21] Appl. No.: 681,785

[22] Filed: Apr. 30, 1976

[51] Int. Cl.[2] ..... F02B 75/10

[52] U.S. Cl. ..... 60/290; 123/97 B

[58] Field of Search ..... 60/290; 123/117 A, 119 A, 123/97 B

[56] References Cited

U.S. PATENT DOCUMENTS

| | | | |
|---|---|---|---|
| 3,975,905 | 8/1976 | Shimo | 60/290 |
| 3,992,878 | 11/1976 | Moorman | 60/290 |

*Primary Examiner*—Douglas Hart

*Attorney, Agent, or Firm*—C. K. Veenstra

[57] ABSTRACT

A control unit creates a control pressure signal which causes a pressure responsive valve assembly to interrupt the flow of secondary air to the exhaust system of an internal combustion engine during prolonged heavy load operation.

2 Claims, 1 Drawing Figure

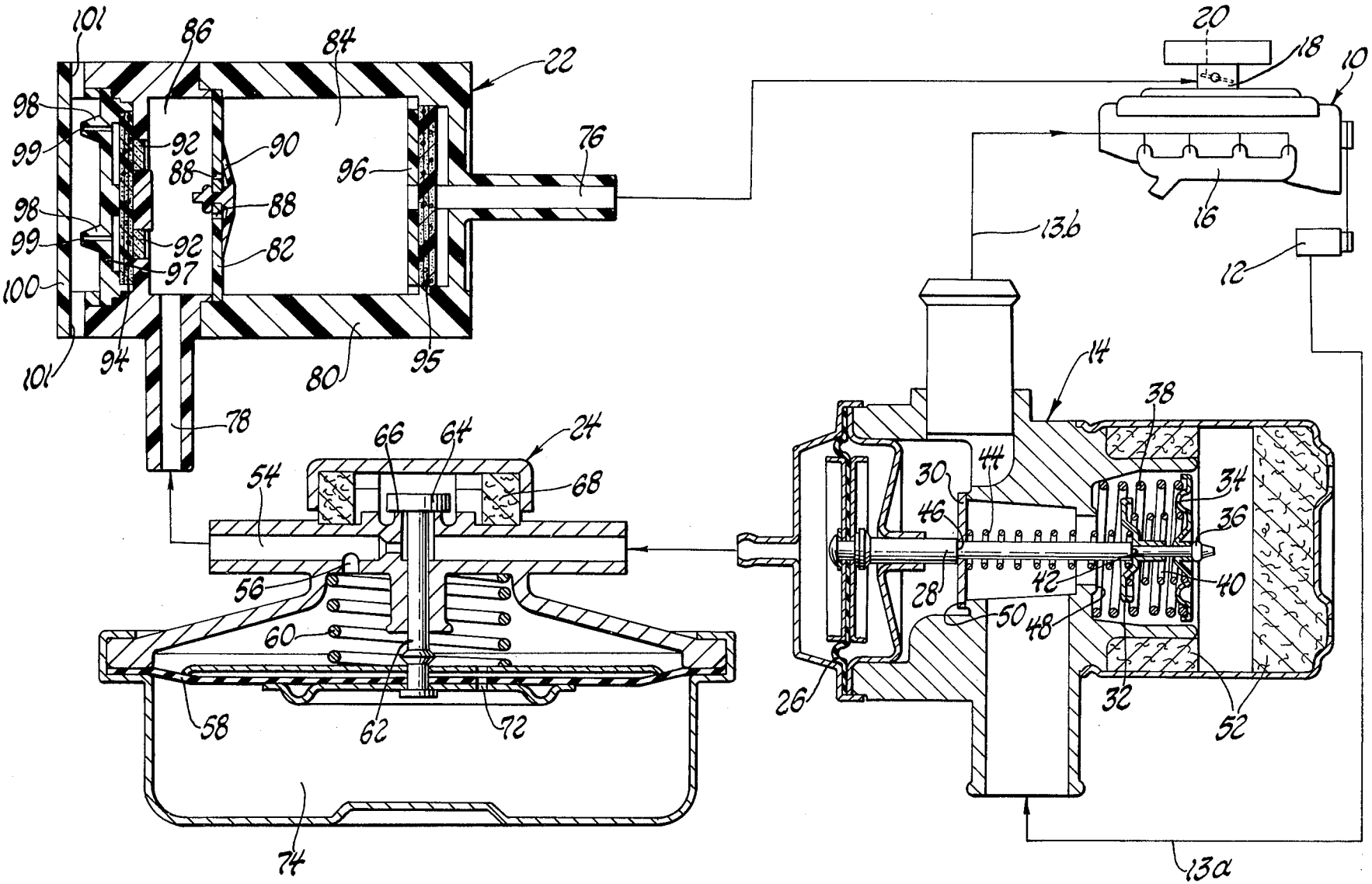
10
18
20
16
12
13a
13b
14
34
36
40
52
38
32
42
48
50
44
30
46
28
26
22
76
95
96
84
80
90
88
82
86
92
88
92
97
78
94
101
98
99
98
99
100
101
24
68
72
64
66
62
54
56
60
58
74

CONTROL UNIT

This invention relates to means useful for controlling the flow of secondary air to an internal combustion engine exhaust system and, more particularly, to a control unit useful for such a system which creates a control signal causing interruption of the air flow to the exhaust system during prolonged heavy load engine operation.

Addition of secondary air to an internal combustion engine exhaust system is an effective means for oxidizing, and thus inhibiting emission of, undesirable exhaust gas constituents. In one application, however, the exothermic oxidation reaction supported by the secondary air could create a potential for undesirable exhaust system temperatures if the engine were operated for a prolonged period of time under heavy loads.

This invention provides a control unit for creating a control signal which, when delivered to an air flow control valve assembly, diverts the secondary air flow from the exhaust system during prolonged operation under heavy loads. Without the secondary air, the oxidation reactions in the exhaust system are limited to preclude undesirable temperatures.

The details as well as other features and advantages of this invention are set forth in the remainder of the specification and are shown in the drawing which illustrates schematically a secondary air flow control system containing a preferred embodiment of this control unit.

Referring to the drawing, an internal combustion engine 10 drives an air pump 12 which delivers air through a conduit **13*a*, 13*b*, including a pressure responsive bypass valve assembly 14, to the engine exhaust manifold 16. Exhaust manifold 16** forms part of an exhaust passage for delivering exhaust gases to other components of the exhaust system such as a catalytic converter and a silencer.

A subatmospheric pressure signal generated in the engine induction passage 18 downstream of a throttle 20 disposed therein is modified by a high pressure control unit 22 to create a generally subatmospheric control pressure signal which is delivered through a low pressure control valve 24 to valve assembly 14.

Within valve assembly 14 the control signal is applied against a diaphragm 26. A valve stem 28 secured to diaphragm 26 has a shut-off valve 30 and a relief valve 32 disposed thereon. A spring seat member 34 is biased against an upset head 36 on stem 28 by a spring 38 which resists the leftward motion induced by the subatmospheric control signal. A spring 40 biases relief valve 32 against a shoulder 42 on stem 28, and a spring 44 biases shut-off valve 30 against a shoulder 46 on stem 28.

When the control signal applied against diaphragm 26 is below the response level of valve assembly 14, diaphragm 26, stem 28 and spring seat 34 move leftwardly against the bias of spring 38, causing spring 40 to engage relief valve 32 against a seat 48 while spring 44 lifts shut-off valve 30 from its seat 50. With shut-off valve 30 lifted from seat 50, air is permitted to flow from pump 12 through seat 50 to exhaust manifold 16. When the control signal applied against diaphragm 26 is above that response level, spring 38 moves spring seat 34, stem 28 and diaphragm 26 rightwardly to the position shown; shoulder 46 then moves shut-off valve 30 against seat 50 while shoulder 42 lifts relief valve 32 away from seat 48. Air flow through seat 50 to exhaust manifold 16 is then interrupted and diverted through seat 48 and silencing material 52 to the atmosphere.

During initial deceleration, air flow to exhaust manifold 16 should be interrupted to avoid exhaust system backfiring. In low pressure control valve 24, the abrupt decrease in induction passage pressure which accompanies deceleration is sensed in a fitting 54 and, through a hole 56, by the upper side of a diaphragm 58. Diaphragm 58 is then raised against the bias of a spring 60, and its stem 62 lifts a valve disc 64 away from a valve seat 66. Air at substantially atmospheric pressure then bleeds through a filter 68 and valve seat 66 and raises the control signal to substantially atmospheric pressure. This pressure is above the response level of valve assembly 14, and spring 38 positions shut-off valve 30 and relief valve 32 as shown to divert air away from exhaust manifold 16.

A small hole 72 connects the upper side of diaphragm 58 with a chamber 74 below diaphragm 58. In a period of time determined essentially by the size of hole 72, the pressure in chamber 74 approaches the pressure above diaphragm 58 and spring 60 returns diaphragm 58 and stem 62 to the position shown. Valve disc 64 then engages valve seat 66 to interrupt the air bleed through valve seat 66, and the control signal sensed in fitting 54 passes directly through control valve 24 to valve assembly 14.

In one application when engine 10 is operated under heavy load for a prolonged period of time, its exhaust gases may contain a relatively high flow rate of unburned constituents. To preclude undesirable exhaust system temperatures under this condition, it may be necessary to interrupt secondary air flow to exhaust manifold 16 to limit exothermic oxidation reactions.

Control unit 22 senses induction system pressure in a fitting 76 and creates the control pressure signal which is delivered through a fitting 78 and low pressure control valve 24 to valve assembly 14. Under normal short periods of acceleration the control signal remains below the response level of valve assembly 14 and holds diaphragm 26 against the bias of spring 38 so that air flow to exhaust manifold 16 is not interrupted. However, when engine 10 is operated under heavy load for a period in excess of 25 to 30 seconds, for example, the control signal delivered through fitting 78 and low pressure control valve 24 to valve assembly 14 is increased above the response level so that spring 38 positions shut-off valve 30 and relief valve 32 as shown to divert air away from exhaust manifold 16.

Control unit 22 has a multiple piece housing 80 which is divided by a partition 82 to form a chamber 84 which senses induction passage pressure through fitting 76 and a chamber 86 which delivers the control pressure signal through fitting 78. Partition 82 has a plurality of apertures 88 which are controlled by an umbrella-type check valve 90 to permit flow from chamber 86 to chamber 84 but to inhibit flow from chamber 84 to chamber 86. A pair of restrictor discs 92 provide a calibrated air bleed which allows a small flow of air — for example 0.01 cmf — to enter chamber 86.

When engine 10 is operating under normal loads, induction passage pressure is received through fitting 76, chamber 84 and apertures 88 in chamber 86 and is delivered from chamber 86 through fitting 78 and low pressure control valve 24 as the control signal to diverter valve assembly 14. This control signal is below the response level of valve assembly 14, and diaphragm 26 acts through stem 28, spring seat 34 and springs 40 and 44 to hold shut-off valve 30 away from seat 50 and thus permit secondary air flow to exhaust manifold 16.

Upon the increase in induction passage pressure which accompanies an increase in load, umbrella valve 90 closes apertures 88, and air admitted through resistor discs 92 to chamber 86 gradually increases the control signal until it equals the induction passage pressure. If the induction passage pressure does not rise above the response level of valve assembly 14, the control signal will not rise above that response level and air flow through valve assembly 14 to exhaust manifold 16 will not be interrupted. In the case of heavy load operation, however, the induction passage pressure will rise above the response level and, after a delay of perhaps 25 to 30 seconds, the control signal also will rise above the response level. During that 25 to 30 second period, umbrella valve 90 will remain closed and the control signal — although gradually increasing because of the air flow through restrictor discs 92 — will hold diaphragm 26 against the bias of spring 38; shut-off valve 30 thus will remain lifted from seat 50 to permit air flow to exhaust manifold 16. At the conclusion of that 25 to 30 second period, the control signal will rise above the response level of valve assembly 14 and spring 38 will position shut-off valve 30 and relief valve 32 as shown to divert air away from exhaust manifold 16. Thus during prolonged operation at heavy load air flow to exhaust manifold 16 is interrupted to limit oxidation reactions in the exhaust system and thereby preclude undesirable exhaust system temperatures.

Restrictor discs 92 are formed of sintered 316 stainless steel with a 7 micron pore size and are protected against plugging by filter cartridges 94 and 95 which are retained by retainer plates 96 and 97. Each of filter cartridges 94 and 95 is a composite including a 60–70 micron nylon screen, a 100 pores-per-inch polyurethane sheet, and a 10 micron paper sheet. Retainer plate 97 is formed with projections 98 surrounding each of the air admitting openings 99 and thus serves as a moisture shield. A dust cover 100 overlies retainer plate 97 and admits air through several openings 101. The various parts of housing 80, including partition 82, retainer plates 96 and 97, and dust cover 100, are formed of heat stabilized nylon and secured by sonic welding.

The embodiments of the invention in which an exclusive property or privilege is claimed are defined as follows:

1. A control unit for use on an internal combustion engine having an induction passage for combustion air flow to the engine, a throttle in said induction passage for controlling air flow therethrough, an exhaust passage for exhaust gas flow from the engine, a conduit for air flow to said exhaust passage to support oxidation of exhaust gases therein, and a pressure responsive valve assembly for controlling air flow through said conduit and adapted to permit air flow through said conduit in response to a control signal below a certain level and to divert air flow from said conduit in response to a control signal above said certain level, said control unit comprising a housing, a partition secured in said housing and defining a first chamber for sensing the induction pressure in said induction passage downstream of said throttle and a second chamber for creating a control signal and transmitting such control signal to said valve assembly, said partition having at least one aperture, an umbrella check valve permitting flow from said second chamber through said aperture to said first chamber and obstructing flow from said first chamber through said aperture to said second chamber, said housing further having at least one sintered metal air bleed opening into said second chamber, a retainer plate overlying said air bleed and having at least one opening for admitting air to said air bleed, said retainer plate further having a projection surrounding said opening to inhibit passage of moisture through said opening, a dust cover overlying said retainer plate, and composite filter cartridges disposed between said retainer plate and said air bleed and between said aperture and said induction passage, said control unit defining means for responding when said induction pressure is constant or decreasing and is below said certain level to create a control signal conforming to said induction pressure and for transmitting such control signal to said valve assembly to permit air flow through said conduit, for responding when said induction pressure increases but is below said certain level to create a control signal which gradually increases toward said induction pressure and for transmitting such control signal to said valve assembly to permit air flow through said conduit, and for responding when said induction pressure increases from below said certain level to above said certain level to create a control signal which gradually increases to above said certain level and for transmitting such control signal to said valve assembly to divert air flow from said conduit upon elapse of an interval following said increase in said induction pressure to above said certain level.

2. A control unit for use on an internal combustion engine having an induction passage for combustion air flow to the engine, a throttle in said induction passage for controlling air flow therethrough, and a pressure responsive assembly for controlling an engine operating condition in one sense in response to a control signal below a certain level and in another sense in response to a control signal above said certain level, said control unit comprising a housing, a partition secured in said housing and defining a first chamber for sensing the induction pressure in said induction passaage downstream of said throttle and a second chamber for creating a control signal and transmitting such control signal to said assembly, said partition having at least one aperture, an umbrella check valve permitting flow from said second chamber through said aperture to said first chamber and obstructing flow from said first chamber through said aperture to said second chamber, said housing further having at least one sintered metal air bleed opening into said second chamber, a retainer plate overlying said air bleed and having at least one opening for admitting air to said air bleed, said retainer plate further having a projection surrounding said opening to inhibit passage of moisture through said opening, a dust cover overlying said retainer plate, and composite filter cartridges disposed between said retainer plate and said air bleed and between said aperture and said induction passage, said control unit defining means for responding when said induction pressure is constant or decreasing and is below said certain level to create a control signal conforming to said induction pressure, for responding when said induction pressure increases but is below said certain level to create a control signal which gradually increases toward said induction pressure, and for responding when said induction pressure increases from below said certain level to above said certain level to create a control signal which gradually increases to above said certain level during an interval following said increase in said induction pressure to above said certain level.

* * * * *